US009022816B2

(12) United States Patent
Endo et al.

(10) Patent No.: US 9,022,816 B2
(45) Date of Patent: May 5, 2015

(54) CONNECTOR TERMINAL AND METHOD OF FABRICATING THE SAME

(71) Applicant: Dai-Ichi Seiko Co., Ltd., Kyoto (JP)

(72) Inventors: Takayoshi Endo, Shizuoka (JP); Daisuke Matsushita, Shizuoka (JP)

(73) Assignee: Dai-Ichi Seiko Co., Ltd., Kyoto (JP)

( * ) Notice: Subject to any disclaimer, the term of this patent is extended or adjusted under 35 U.S.C. 154(b) by 80 days.

(21) Appl. No.: 13/930,157

(22) Filed: Jun. 28, 2013

(65) Prior Publication Data

US 2014/0011413 A1 Jan. 9, 2014

(30) Foreign Application Priority Data

Jul. 3, 2012 (JP) ..... 2012-149626

(51) Int. Cl.

| | |
|---|---|
| ***H01R 13/11*** | (2006.01) |
| ***H01R 43/16*** | (2006.01) |
| *H01R 13/24* | (2006.01) |
| *H01R 13/03* | (2006.01) |

(52) U.S. Cl.

CPC ..... *H01R 13/112* (2013.01); *H01R 13/2464* (2013.01); *H01R 43/16* (2013.01); *H01R 13/03* (2013.01)

(58) Field of Classification Search

CPC ..... H01R 13/112
USPC ..... 439/857, 856
See application file for complete search history.

(56) References Cited

U.S. PATENT DOCUMENTS

| | | | | |
|---|---|---|---|---|
| 3,656,093 | A * | 4/1972 | Kinkaid | 439/872 |
| 3,713,079 | A | 1/1973 | Dechelette | |
| 6,254,440 | B1 | 7/2001 | Ko et al. | |
| 6,475,041 | B1 * | 11/2002 | Lappohn et al. | 439/856 |

FOREIGN PATENT DOCUMENTS

| | | |
|---|---|---|
| DE | 2 237 064 | 2/1974 |
| EP | 0 645 843 | 3/1995 |
| EP | 0 975 057 | 1/2000 |
| EP | 1 148 588 | 10/2001 |
| JP | 59-17571 | 2/1984 |
| JP | 4-206175 | 7/1992 |
| JP | 2001-326010 | 11/2001 |
| JP | 2003-303631 | 10/2003 |

OTHER PUBLICATIONS

European Search Report (ESR) issued Oct. 4, 2013 in corresponding European Patent Application No. EP 13 17 3049.
Japanese Office Action (OA) issued Jul. 30, 2013 in Japanese Patent Application No. 2012-149626.

* cited by examiner

*Primary Examiner* — Phuong Dinh
(74) *Attorney, Agent, or Firm* — Wenderoth, Lind & Ponack, L.L.P.

(57) ABSTRACT

A connector terminal includes a pair of terminal contacts sandwiching a male connector therebetween to make electric contact with the male connector, and a terminal body supporting the pair of terminal contacts. The terminal contacts are formed by bending a metal plate having been punched into a designed shape. The terminal contacts each include a contact surface formed by bending a contact part not facing the other contact part and extending towards a central axis of the terminal body.

18 Claims, 22 Drawing Sheets

PRIOR ART

CONNECTOR TERMINAL AND METHOD OF FABRICATING THE SAME

BACKGROUND OF THE INVENTION

1. Field of the Invention

The invention relates to a connector terminal including a pair of terminal contacts between which a male connector terminal is sandwiched for fixing the male connector terminal there and making electrical contact with the male connector terminal. The invention further relates to a method of fabricating such a connector terminal.

2. Description of the Related Art

There is known an electric connector into which a fuse called a flat fuse or a plate fuse including a pair of plate-shaped connector terminals extending in the same direction from opposite ends of a main body to be molten is inserted. The electric connector includes a connector terminal called a fork terminal or a Y-shaped terminal including a pair of terminal contacts between which plate-shaped connector terminals of a fuse as a male connector terminal is inserted and sandwiched.

Such a connector terminal is disclosed in Japanese Patent Application Publication Nos. 2001-326010 and H04(1992)-206175, for instance.

FIG. 17 illustrates a fork terminal disclosed in Japanese Patent Application Publication No. 2001-326010.

A metal plate 4 includes a main layer 2 composed of Cu alloy, and plated layers formed on opposite surfaces of the main layer 2 and composed of Au or Ag. The plate 4 is punched into a fork terminal 5. The thus fabricated fork terminal 5 includes a pair of contacts 6*a* and 6*b* each having contact surfaces 7*a* and 7*b* through which the fork terminal 5 makes electric contact with terminals of another electric part (for instance, a male connector terminal). The fork terminal 5 is subject to burring treatment such that the plated layers 2 and 3 are exposed outside.

FIG. 18 illustrates a connector disclosed in Japanese Patent Application Publication No. H04(1992)-206175.

The connector 9 is formed by punching a metal plate into a fork shape, and includes a pair of contacts 8*a* and 8*b* perpendicularly bent in opposite directions. A male connector terminal is inserted into and sandwiched between the contacts 8*a* and 8*b*.

If a connector includes rough surfaces (namely, just bladed surfaces without being treated) with which a male connector terminal makes contact, the male connector terminal will be damaged when the male connector terminal slides with the rough surface, Further, tiny shaved portions of the male connector terminal will accumulate on the rough surface with the result that contact reliability between the connector and the male connector terminal is deteriorated, and that a frictional force between the connector and the male connector terminal is increased. Accordingly, the male connector terminal cannot be smoothly inserted into and pulled out of the connector. The connector terminals disclosed in the above-mentioned Publications are designed to include plated contact surfaces through which the connector terminals make contact with a male connector terminal, by bending contact portions such that surfaces having been just bladed or punched do not form contact surfaces through which the connector terminals make contact with a male connector terminal, for the purpose of preventing corrosion of the contact surfaces and accordingly enhancing contact reliability. Thus, the connector terminals disclosed in the above-mentioned Publications are able to solve the above-mentioned problem.

However, if contact portions of a pair of the terminal contacts were formed by bending a metal plate along a fold line extending in a direction in which a male connector terminal is inserted into and pulled out of the terminal contacts, similarly to the above-mentioned conventional connector terminals, a space between the terminal contacts could not avoid being long. If the terminal contacts were spaced away from each other by a long space, the terminal contacts could not sandwich a male connector terminal therebetween, resulting in deterioration in reliability. Furthermore, a connector terminal cannot be down-sized because of a long space between a pair of the terminal contacts.

SUMMARY OF THE INVENTION

In view of the above-mentioned problems in the conventional connector terminals, it is an object of the present invention to provide a connector terminal which is down-sized and provides high reliability by not creating a long space between the terminal contacts, and by designing a contact surface at which the connector terminal makes contact with a male connector terminal to be comprised of a plated surface of a terminal contact.

In one aspect of the present invention, a connector terminal includes a pair of terminal contacts sandwiching a male connector therebetween to make electric contact with the male connector; and a terminal body supports the pair of terminal contacts. The terminal contacts are formed by bending a metal plate having been punched into a designed shape, and the terminal contacts each include a contact surface formed by bending a contact part not facing the other contact part and extending towards a central axis of the terminal body, thereby cause the contact surfaces of the pair of terminal contacts to face each other at a determined position after bending.

In accordance with the present invention, the terminal contacts are formed by bending a contact part not facing the other contact part and extending towards a central axis of the terminal body. Accordingly, it is possible to make the plated contact parts without interfering with each other in fabrication of the contact parts out of a metal plate, and further, without much spacing of the contact surfaces, which face each other, away from each other.

It is preferable that the contact part extends beyond the central axis of the terminal body before bending. By designing the contact part to extend beyond the central axis of the terminal body, the contact surface can be designed to have a large area without increasing a space between the contact surfaces facing each other.

It is preferable that one of the pair of terminal contacts is formed by bending a first portion including a first part extending towards a first direction in which the male connector is pulled out of the connector terminal, and the first portion further includes the contact part extending from the first part. The other of the pair of terminal contacts is formed by bending a second portion including a second part turning back towards a second direction in which the male connector is inserted into the connector terminal, and the second portion further includes the contact part extending from the second part. One of the contact parts is bent in a direction intersecting with the first direction to thereby cause a contact surface of the contact part to face the central axis, and the first part is folded. The other of the contact parts is bent in a direction intersecting with the second direction to thereby cause a contact surface of the contact part to face the central axis, and the second part is folded. By so designing the pair of terminal contacts, it is possible to shorten a space between the contact surfaces.

It is preferable that one of the pair of terminal contacts is formed by bending a first portion including a first part extending towards a first direction in which the male connector is pulled out of the connector terminal, and the first portion further including the contact part extending from the first part. The other of the pair of terminal contacts is formed by bending a second portion including a second part extending towards the first direction, the second portion further including the contact part extending from the second part. The position of the one contact part is different from the position of the other contact part along the first direction. One of the contact parts is bent in a direction intersecting with the first direction to thereby cause a contact surface of the contact part to face the central axis, and the first part is folded. The other of the contact parts is bent in a direction intersecting with the first direction to thereby cause a contact surface of the contact part to face the central axis, and said second part is folded. By so designing the pair of terminal contacts, it is possible to shorten a space between the contact surfaces.

It is preferable that the terminal body includes a pair of compressing portions extending towards the central axis, and the contact part is bent ahead of the compressing portion. It is possible to locate the contact part ahead of the compressing portion, and direct the contact surface to a male connector terminal.

It is preferable that each of the compressing portions has an arcuate distal end, and the contact part has an arcuate surface extending along the arcuate distal end of each of the compressing portions. By designing the contact part to be arcuate, it is possible to reduce friction between the contact part and a male connector terminal, ensuring that a male connector terminal can be smoothly inserted into and pulled out of the connector terminal. Furthermore, since the contact part has an arcuate surface extending along the arcuate distal end of the compressing portion, a compression force acting on the compression portion can be surely transferred to a rear surface of the contact part, ensuring that a male connector terminal can be surely sandwiched between the contact parts.

It is preferable that the first portion and the second portion are thinner than the terminal body. By designing the first portion to be thin, the folded first portion is not thick, and hence, the folded first portion can have almost the same thickness as that of the terminal body, ensuring that the folded first portion can be smoothly inserted into a housing.

It is preferable that the terminal body has a step at each boundary with the first portion and the second portion, and each of the first part and the second part is bent inwardly of the step. Since the first portion is bent inwardly of the step in a thickness-wise direction, the first portion is prevented from being deformed by virtue of the step. Thus, it is possible to prevent the first portion from being outwardly deformed in a thickness-wise direction, by virtue of a reaction force generated when a male connector terminal is sandwiched between the contact surfaces.

In another aspect of the present invention, there is provided a method of fabricating a terminal connector including a pair of terminal contacts sandwiching a male connector therebetween to make electric contact with the male connector, and a terminal body supporting the pair of terminal contacts. The method includes (a) forming a pair of contact parts which do not face each other, and (b) bending the contact parts to thereby form the pair of terminal contacts at a determined position.

It is preferable that a contact part corresponding to one of the terminal contacts, which does not face a contact part corresponding to the other of the terminal contacts, and extending towards a central axis of the terminal body is bent to thereby form a contact surface of each of the terminal contacts in the step (b).

It is preferable that one of the pair of terminal contacts is formed by bending a first portion including a first part extending towards a first direction in which the male connector is pulled out of said connector terminal, and the first portion further includes the contact part extending from the first part. The other of the pair of terminal contacts is formed by bending a second portion including a second part extending towards a second direction in which the male connector is inserted into the connector terminal, the second portion further including the contact part extending from the second part. The position of the one contact part is different from the position of the other contact part along the first direction. One of the contact parts is bent in a direction intersecting with the first direction to thereby cause a contact surface of the contact part to face the central axis, and the first part is folded. The other of the contact parts is bent in a direction intersecting with the second direction to thereby cause a contact surface of the contact part to face the central axis, and the second part is folded.

It is preferable that one of the pair of terminal contacts is formed by bending a first portion including a first part extending towards a first direction in which the male connector is pulled out of the connector terminal, the first portion further including the contact part extending from the first part. The other of the pair of terminal contacts is formed by bending a second portion including a second part extending towards the first direction, the second portion further including the contact part extending from the second part. The position of the one contact part is different from the position of the other contact part along the first direction. One of the contact parts is bent in a direction intersecting with the first direction to thereby cause a contact surface of the contact part to face the central axis, and the first part is folded. The other of the contact parts is bent in a direction intersecting with the second direction to thereby cause a contact surface of the contact part to face the central axis, and the second part is folded.

It is preferable that the contact part is bent ahead of a compressing portion included in the terminal body and extending towards the central axis.

It is preferable that the first part is bent inwardly of a first step formed in the terminal body at a first boundary between the predetermined area and the first portion, and the second part is bent inwardly of a second step formed in the terminal body at a second boundary between the predetermined area and the second portion.

It is preferable that the method further includes thinning a predetermined area in the terminal body, the contact parts being formed in the predetermined area.

The advantages obtained by the aforementioned present invention will be described hereinbelow.

In accordance with the present invention, it is possible to fabricate the contact surfaces without increasing a space between the contact surfaces facing each other. Accordingly, it is possible to sandwich a male connector terminal through the smooth and plated contact surfaces of the terminal contacts without increasing a size of the terminal body. Thus, the present invention provides a down-sized connector terminal presenting high reliability without increasing a space between the connector contacts by designing the contact surfaces, at which the connector terminal makes contact with a male connector terminal, to be plated surfaces of a smooth metal plate just having been bent.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS

Figure 1:
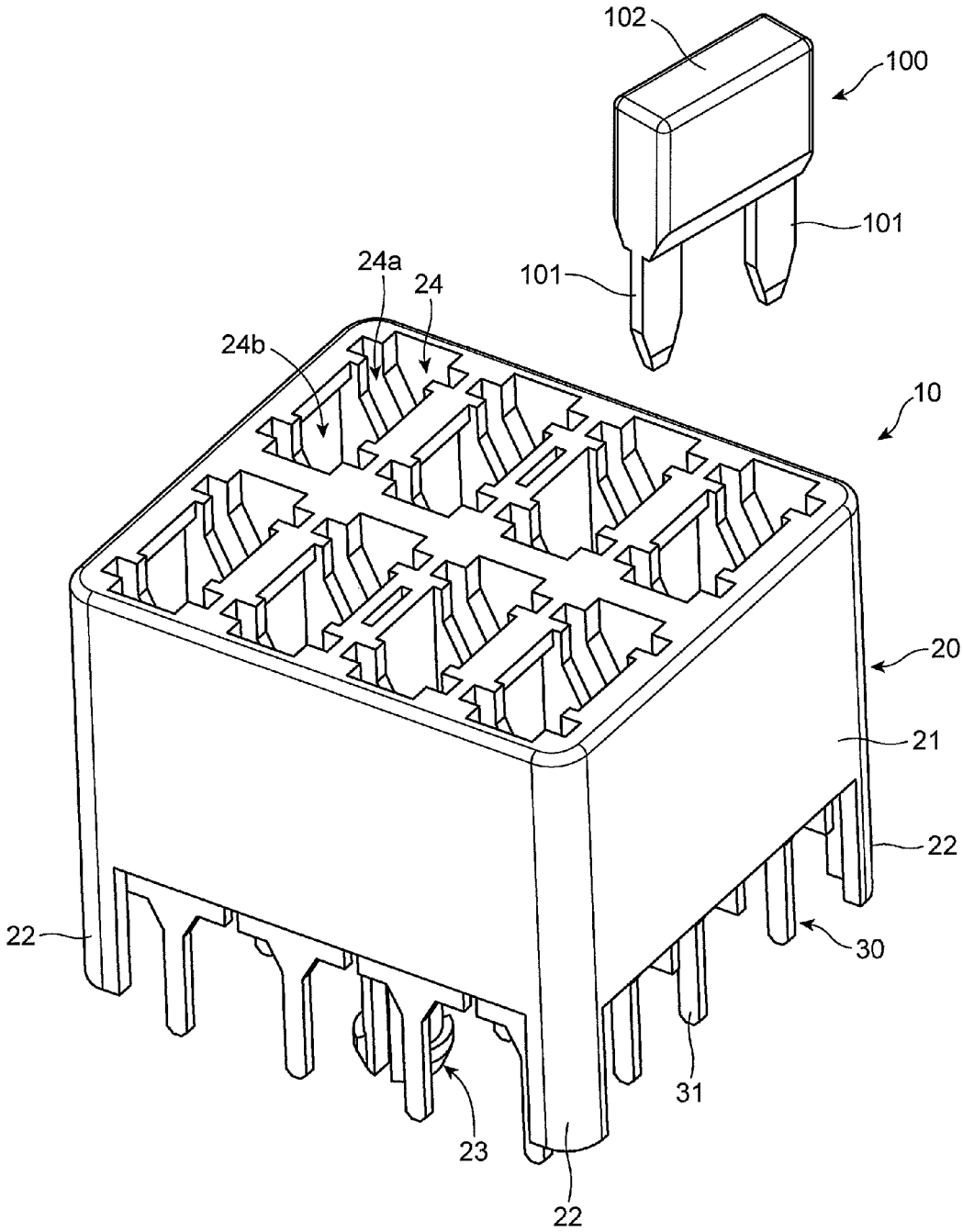
FIG. 1 is a perspective view of both the electric connector in accordance with a preferred embodiment of the present invention, and a fuse to be inserted into the electric connector.

A preferred embodiment in accordance with the present invention will be explained hereinbelow with reference to drawings.

The electric connector 10 illustrated in FIGS. 1 to 5 electrically connects a fuse 100 to a printed circuit board (not illustrated) in order to protect electric circuits from overcurrent. The fuse 100 includes a fuse body 102, and a pair of plate-shaped connector terminals 101 each acting as a male connector terminal and extending from the fuse body 102 in the same direction.

The electric connector 10 includes an electrically insulating housing 20 composed of resin, and connector terminals 30.

Figure 2:
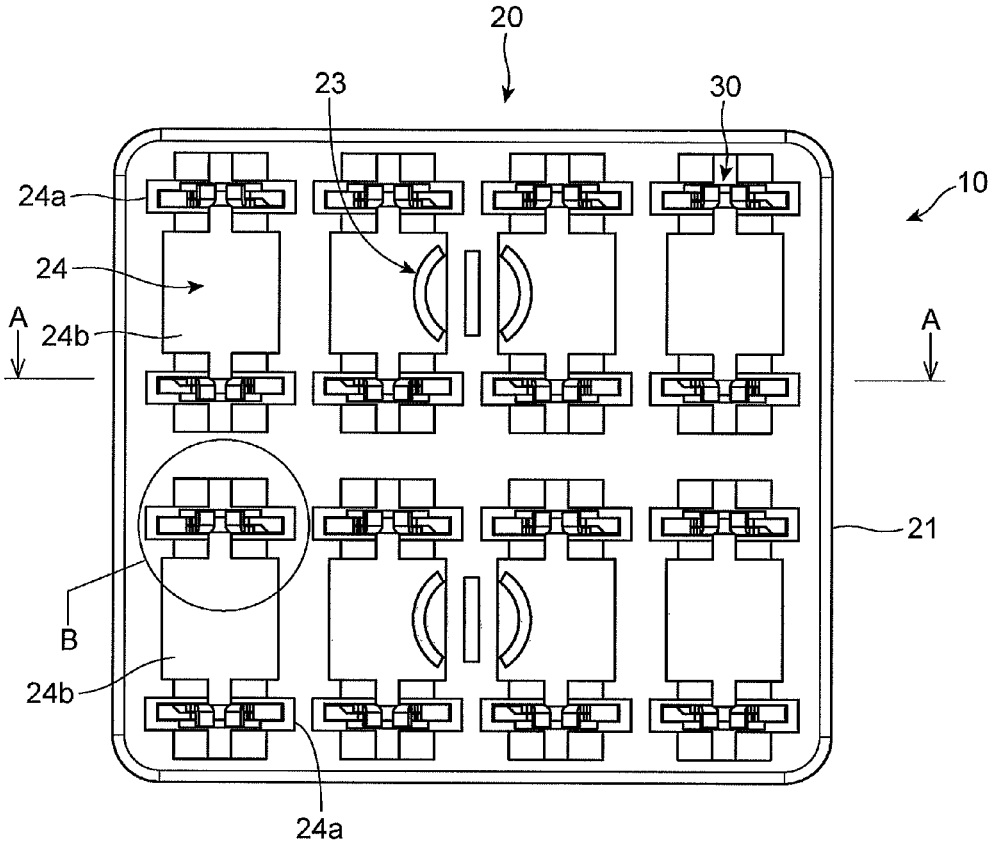
FIG. 2 is a plan view of the electric connector illustrated in FIG. 1.
Figure 3:
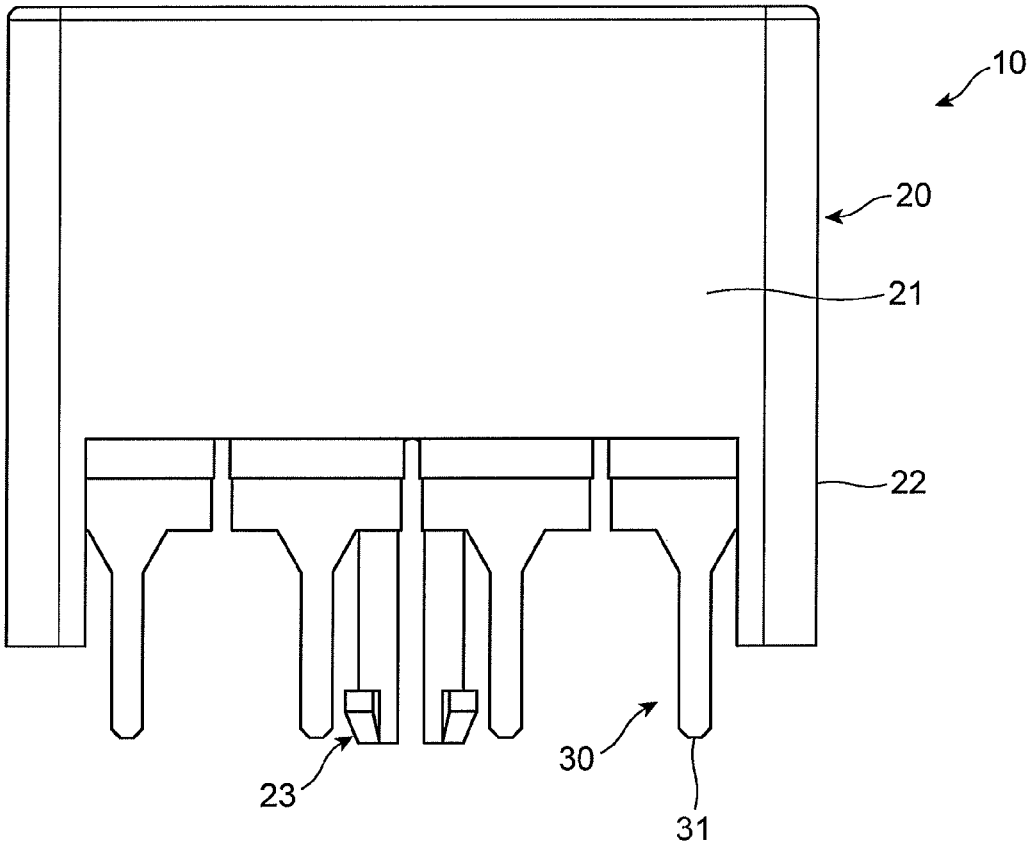
FIG. 3 is a front view of the electric connector illustrated in FIG. 1.

The electrically insulating housing 20 is substantially rectangular, when viewed in a direction in which the connector terminal 101 is inserted into the housing 20. The housing 20 has four support legs 22 at corners on a bottom of a housing main body 21 of the housing 20. At a center on a bottom of the housing 20 are formed fixed legs 23 to be inserted into a printed circuit board for fixing the electric connector 10. Each of the fixed legs 23 includes a pair of semi-circular walls arranged to make a circle, and has a wedge (see FIG. 3) at a distal end. The wedge makes engagement with an edge of a through-hole of a printed circuit board, when the fixed legs 23 are inserted into the printed circuit board. As illustrated in FIG. 2, the housing 20 is designed to include eight connector rooms 24 by four rows and two columns.

Figure 4:
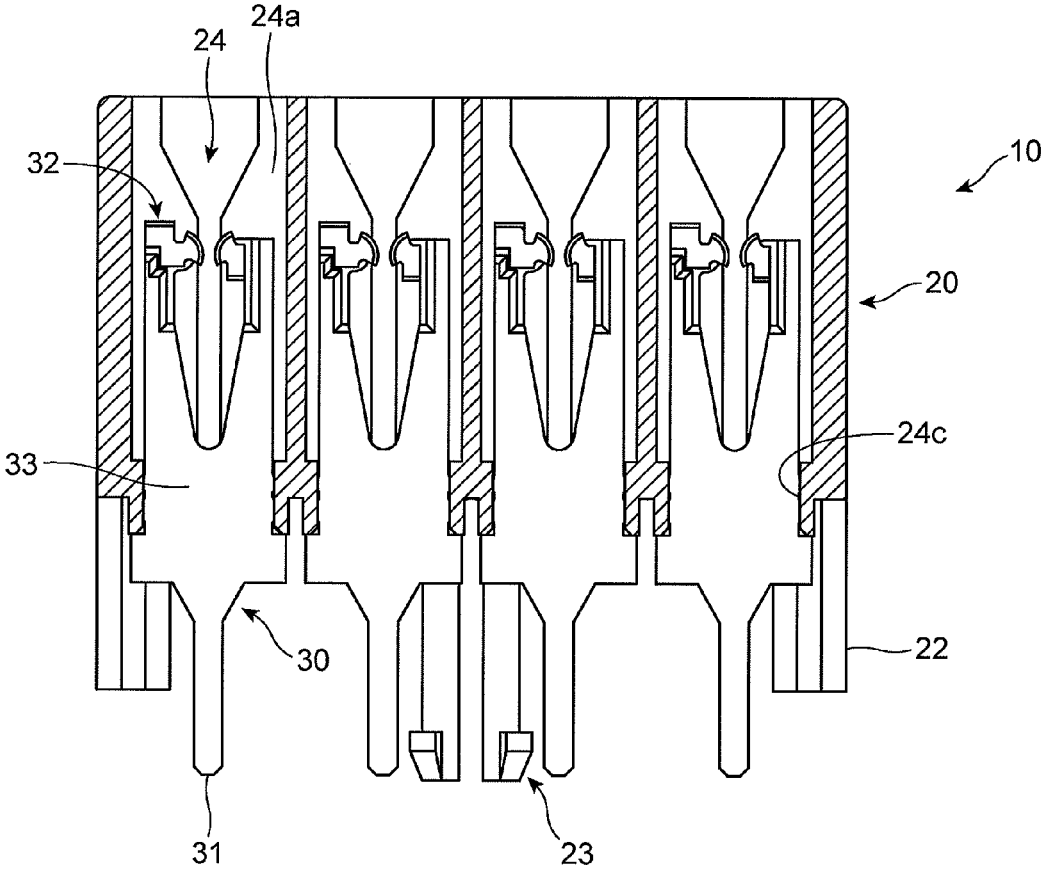
FIG. 4 is a cross-sectional view taken along the line A-A shown in FIG. 2.
Figure 5:
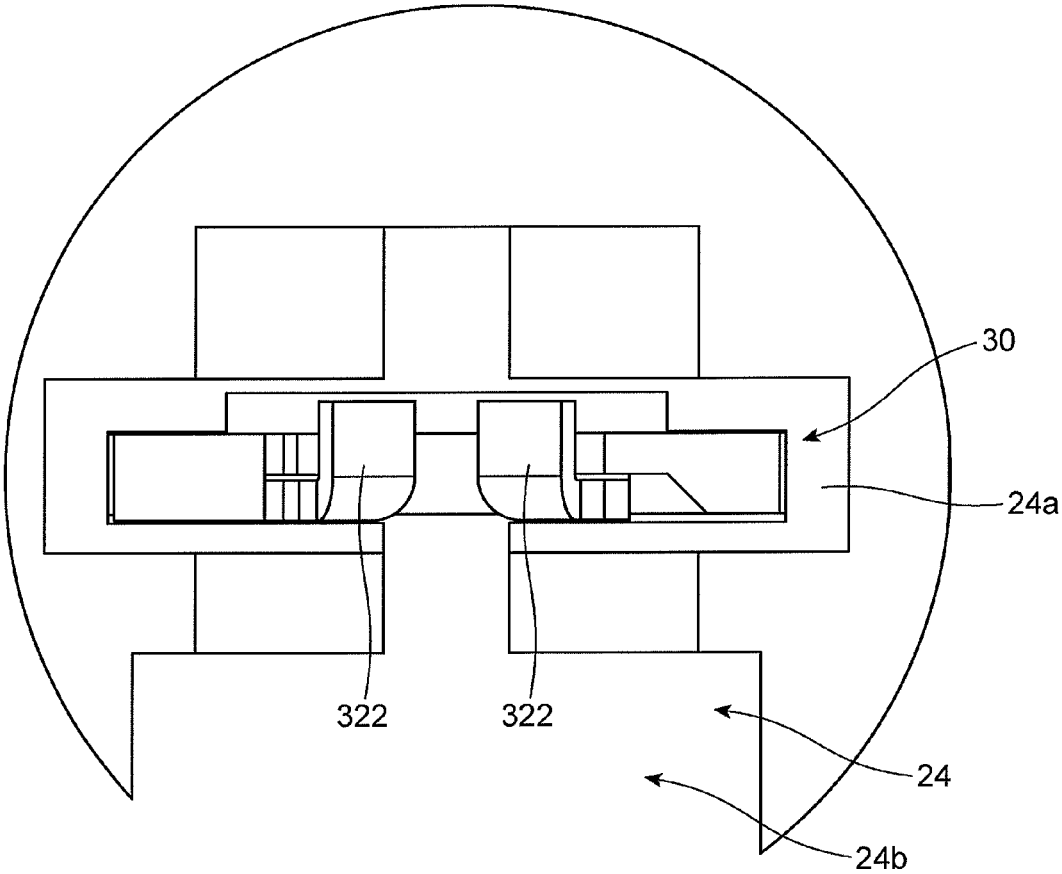
FIG. 5 is an enlarged view of the portion B shown in FIG. 2.
Figure 6:
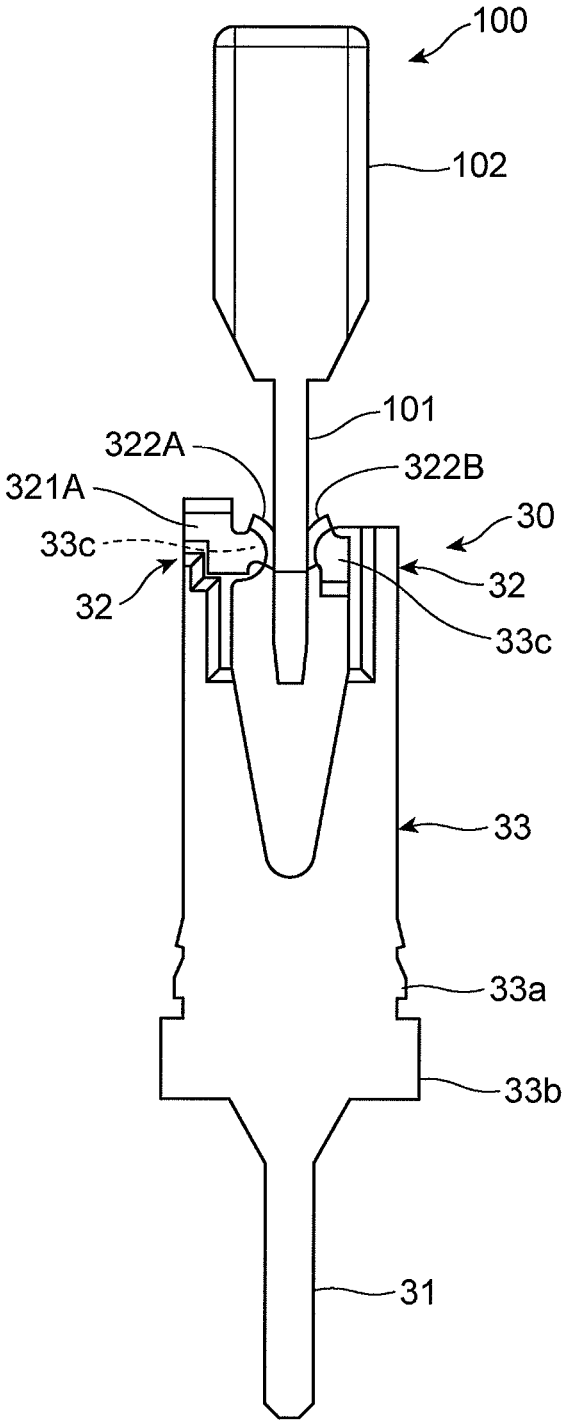
FIG. 6 is a front view of the electric connector illustrated in FIG. 1, into which a fuse was inserted.
Figure 7:
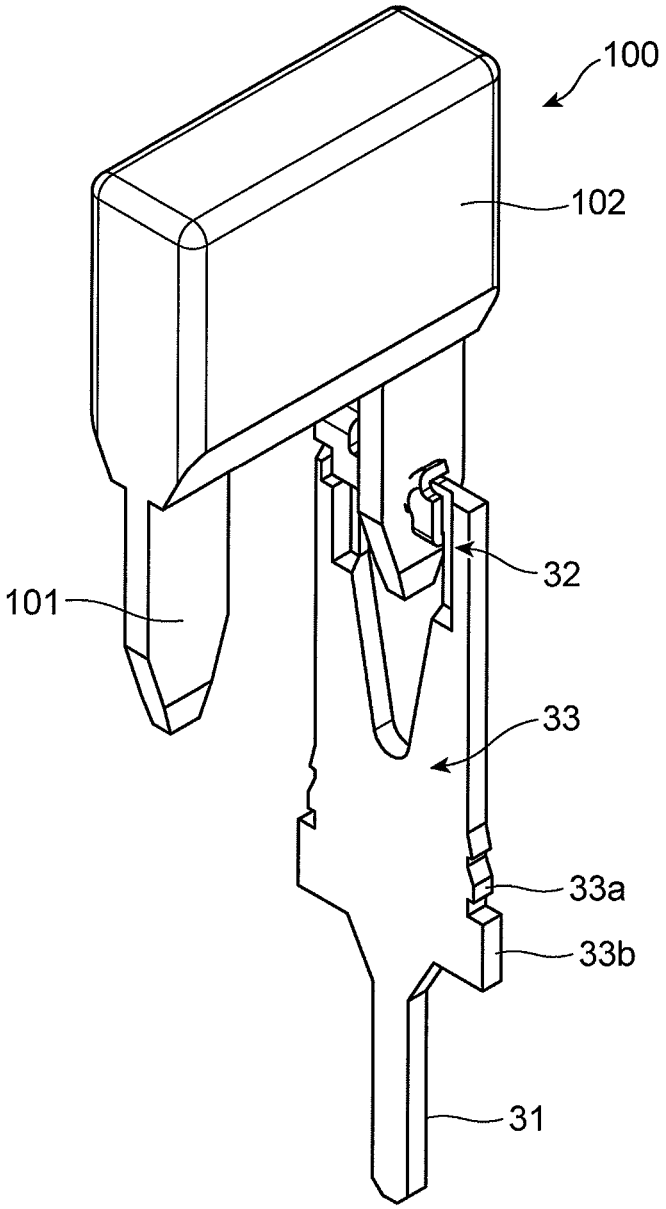
FIG. 7 is a perspective view of the electric connector illustrated in FIG. 6, into which a fuse was inserted.
Figure 8:
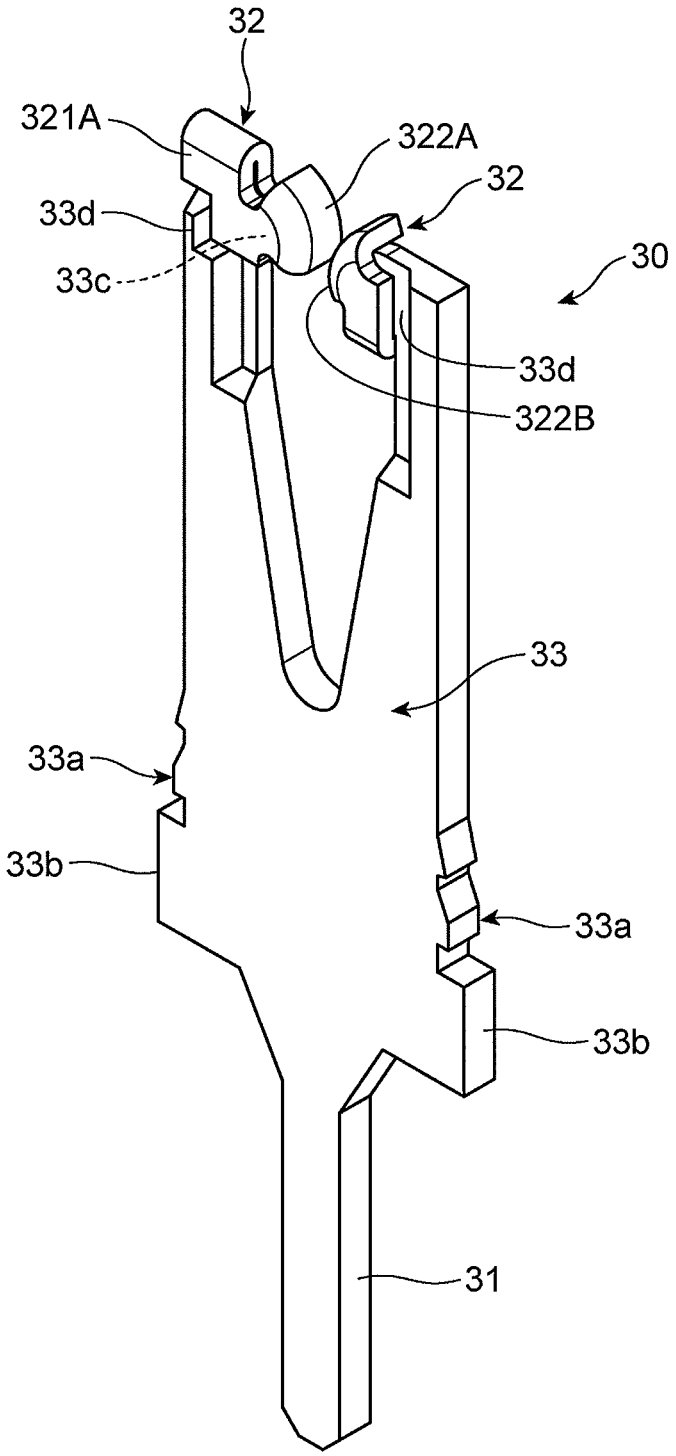
FIG. 8 is a perspective view of the electric connector illustrated in FIG. 7.

As illustrated in FIG. 2, each of the connector rooms 24 includes two terminal openings 24*a* into which a pair of the connector terminals 30 are inserted with the connector terminals 30 facing each other, and a fuse opening 24*b* into which the fuse body 102 is inserted. As illustrated in FIG. 4, a width-reduced portion 24*c* is formed at a lower end of the terminal opening 24*a* for making engagement with an engagement portion of the connector terminal 30 inserted into the housing 20 through a bottom of the housing 20.

Figure 9:
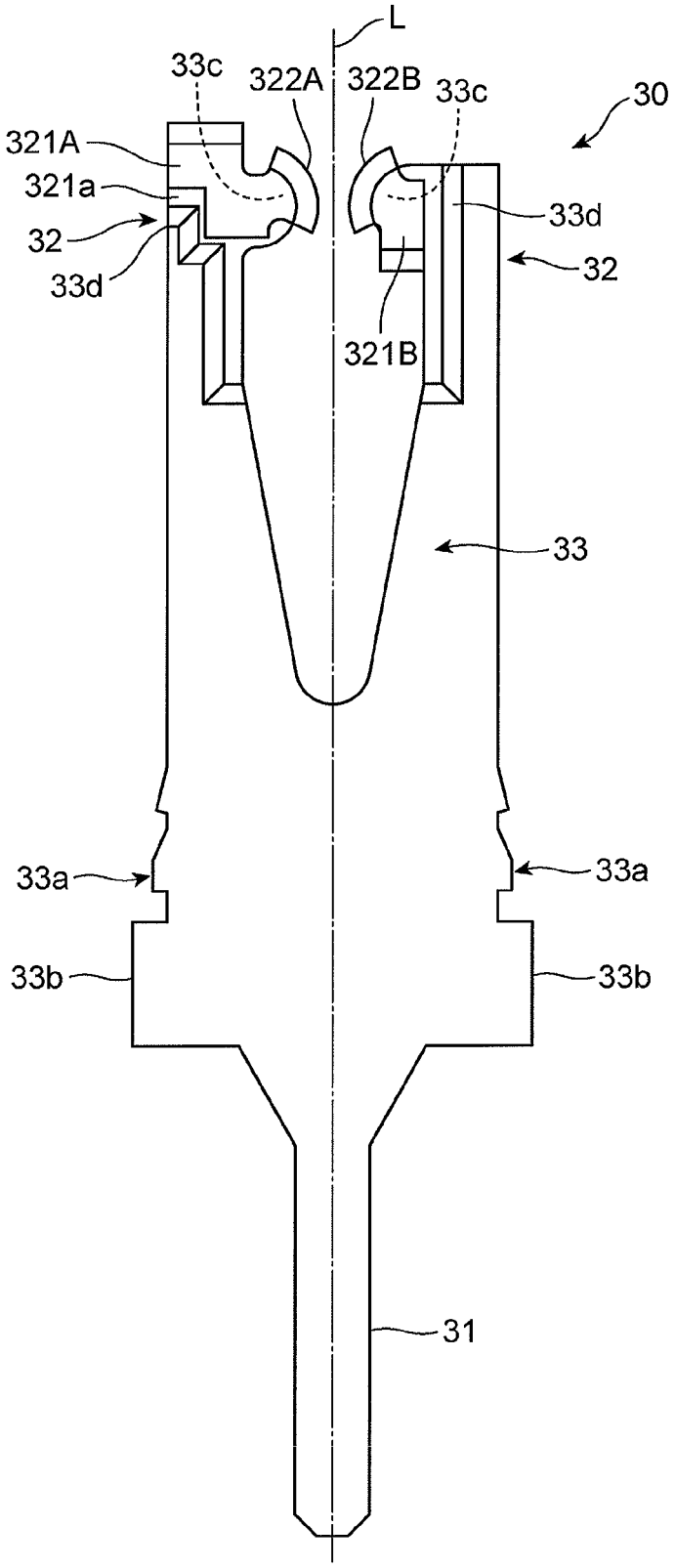
FIG. 9 is a front view of the electric connector illustrated in FIG. 8.
Figure 10:
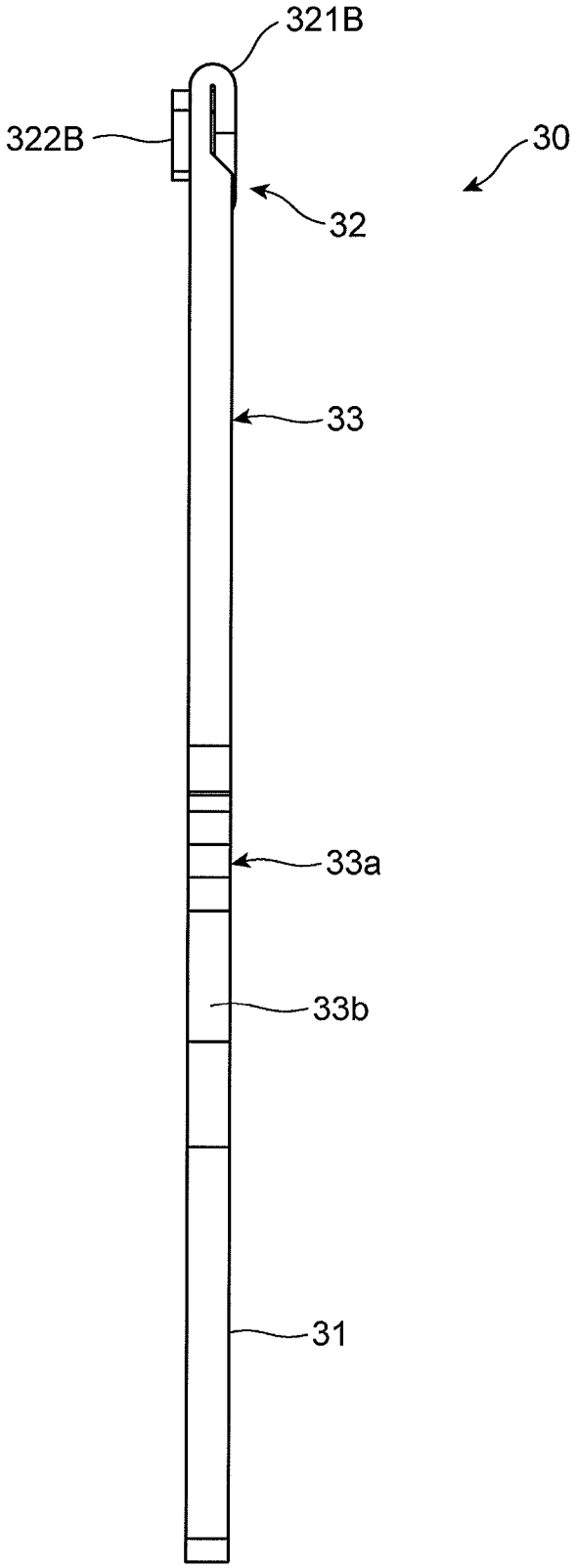
FIG. 10 is a side view of the electric connector illustrated in FIG. 8.

As illustrated in FIGS. 6 to 10, the connector terminal 30 is a fork terminal to be fabricated by punching a plated metal plate into a Y shape, and bending the plate in a manner mentioned later. As illustrated in FIG. 9, the connector terminal 30 includes a connector portion 31 inserted into a printed circuit board on which the electric connector 10 is mounted, a pair of terminal contacts 32 sandwiching a male connector terminal therebetween and making electrical contact with the male connector terminal, and a terminal body 33 supporting each of the terminal contacts 32.

The terminal contacts 32 are formed at a distal end of the terminal body 33. The terminal contacts 32 are formed by folding a first portion 320A (see FIGS. 11A and 11B) extending in a first direction in which the connector terminals 101 are pulled out of the housing 20, and further folding a second portion 320B (see FIGS. 11A and 11B) extending in a second direction in which the connector terminals 101 are inserted into the housing 20.

As illustrated in FIG. 9, the first portion 320A includes a first part 321A to be folded into two layers, and a contact part 322A to be bent from the folded first part 321A and located ahead of a compressing portion 33*c* to thereby define a contact surface. Similarly, the second portion 320B includes a second part 321B to be folded into two layers, and a contact part 322B to be bent from the folded second part 321B and located ahead of a compressing portion 33*c* to thereby define a contact surface. After folding, the contact parts 322A and 322B face each other at a determined position.

Figure 11A:
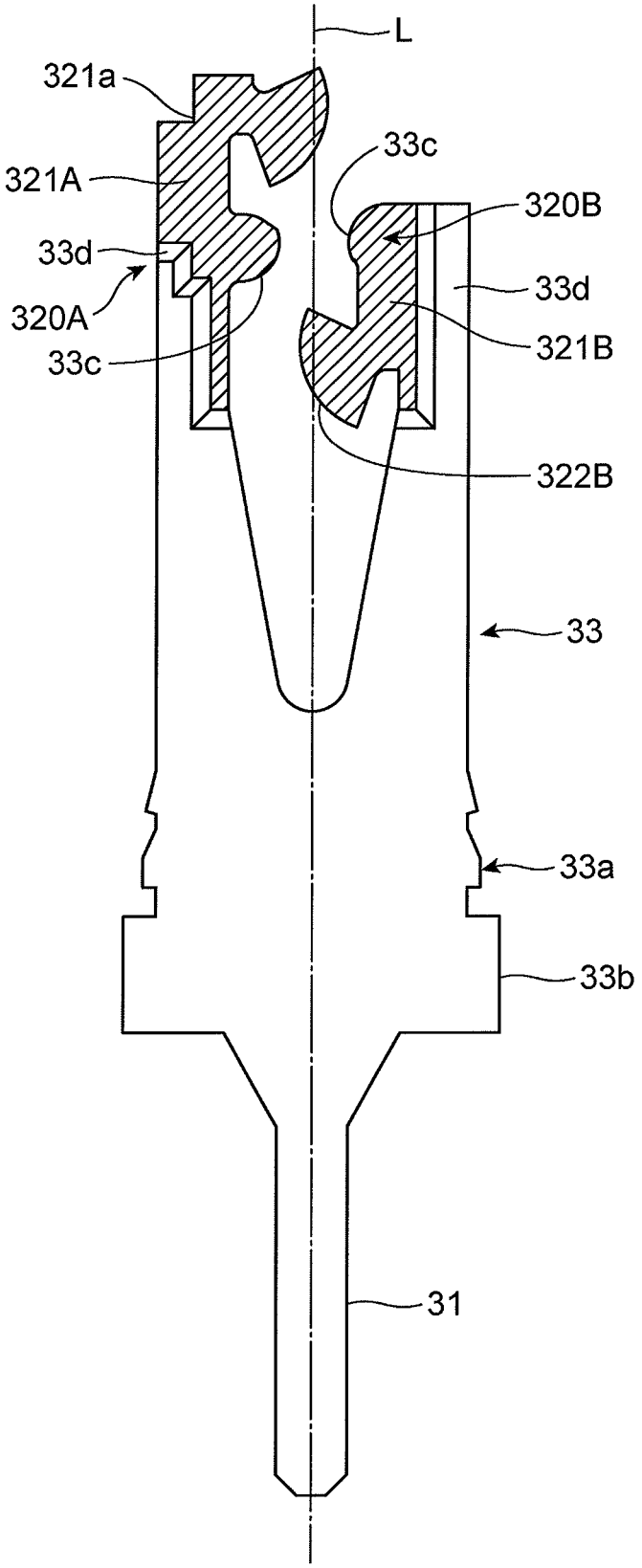
FIG. 11A is a front view of the connector terminal, showing that the first portion is collapsed.
Figure 11B:
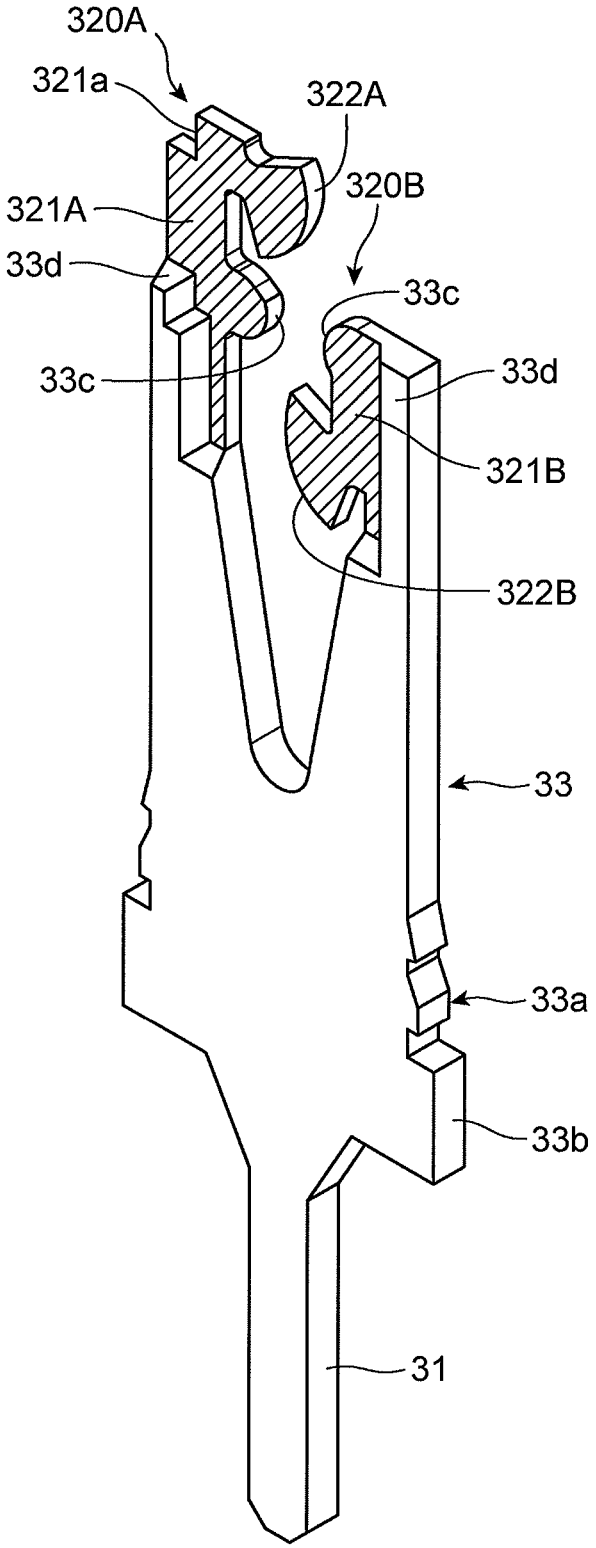
FIG. 11B is a perspective view of FIG. 11A.

The first part 321A and the second part 321B are substantially rectangular, respectively. As illustrated in FIGS. 11A and 11B, the first part 321A is formed with a cut-out 321*a* outwardly in a thickness-wise direction. Specifically, the cut-out 321*a* is formed at a corner of the first part 321A.

The contact parts 322A and 322B extend from the first part 321A and the second part 321B beyond a central axis L towards each other, respectively. Each of the contact parts 322A and 322B is arcuate.

The terminal body 33 is designed to include the connector portion 31 at a bottom and a pair of the terminal contacts 32 at a head, and further, to be V-shaped. The terminal body 33 further includes engagement portions 33*a* which make engagement with the width-reduced portions 24*c* formed in each of the connector rooms 24 of the housing 20, when the connector terminal 30 is inserted into the connector room 24, and width-increased portions 33*b* which has a width greater than an opening of the connector room 24 to thereby prevent the connector terminal 30 from being excessively inserted into the connector room 24. The terminal body 33 includes, at a head thereof, the compressing portions 33*c* extending such that they face each other. Each of the compressing portions 33*c* is substantially semi-circular, and hence, is arcuate at a head thereof.

Hereinbelow, a method of fabricating the connector terminal 30 in accordance with the preferred embodiment of the present invention is explained with reference to the drawings.

First, a plated metal plate is punched into a shape illustrated in FIGS. 11A and 11B to thereby form a base plate from which the connector terminal 30 is fabricated. A cut-out is formed between the first portion 320B and the terminal body 33 such that the compressing portion 33*c* remains.

Then, an area (hatched in FIGS. 11A and 11B) including the first portion 320A, the compressing portion 33*c*, and the rectangular area, and an area (hatched in FIGS. 11A and 11B) including the first portion 320B, the compressing portion 33*c*, and the rectangular area are collapsed to be thinner than the terminal body 33. When the first portion 320A and the second portion 320B are collapsed to be thin, there is formed a convex step 33*d* between the first portion 320A and the terminal body 33, and there is also formed a step 33*d* along the second part 321B in the second portion 320B.

Figure 12A:
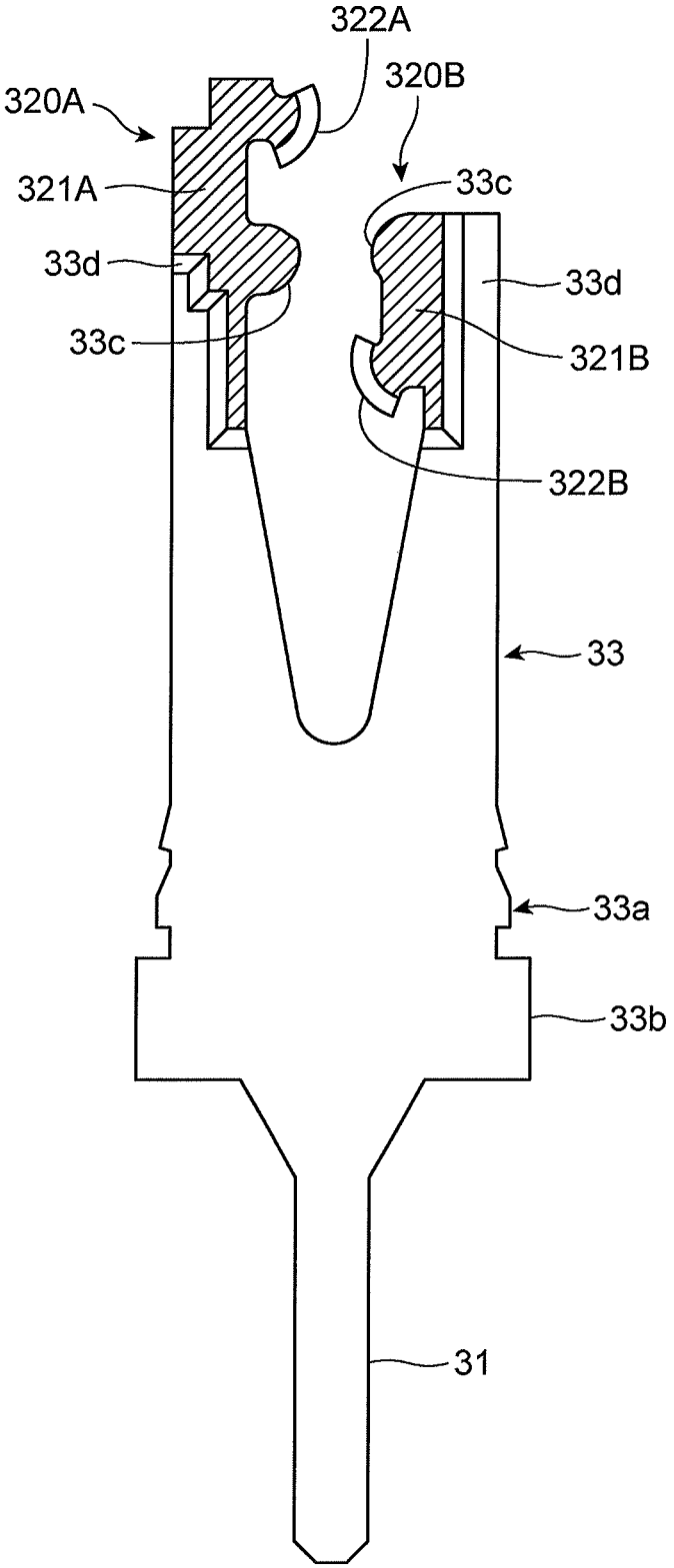
FIG. 12A is a front view of the connector terminal, showing that the contact part is bent.
Figure 12B:
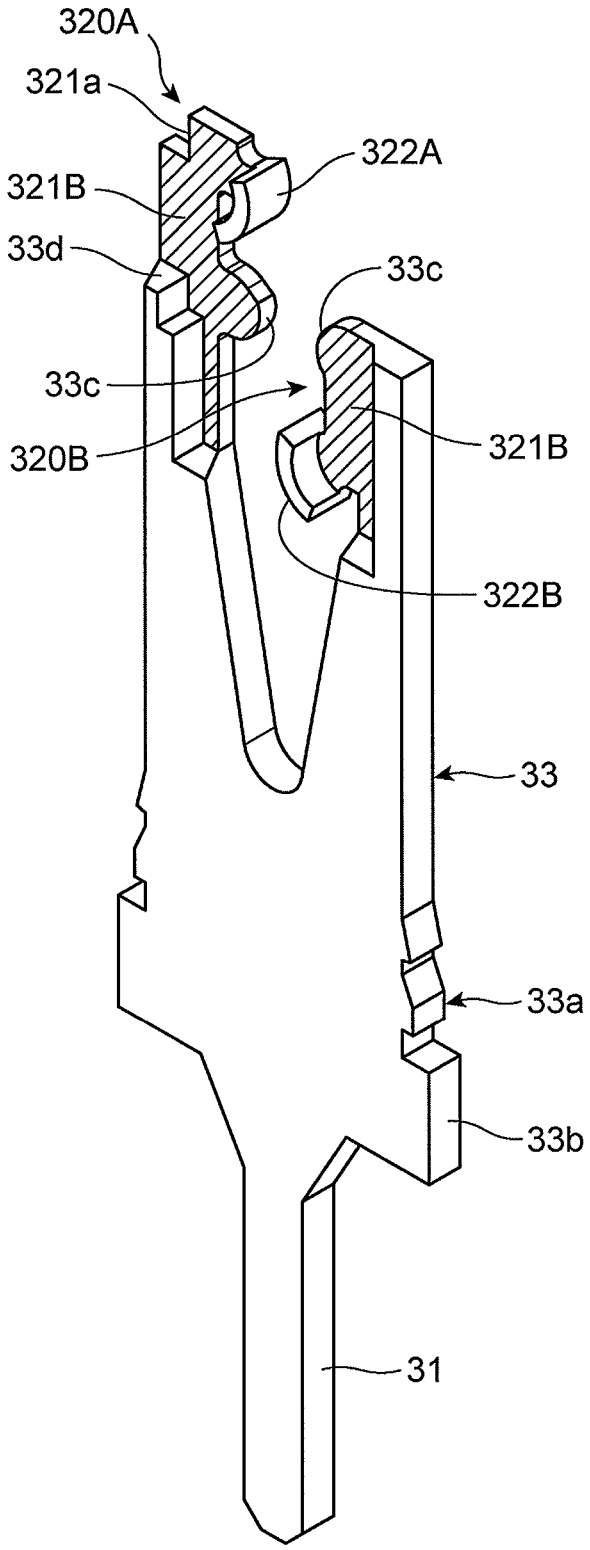
FIG. 12B is a perspective view of FIG. 12A.

Then, as illustrated in FIGS. 12A and 12B, the contact parts 322A and 322B are bent by stroking and bending process in a direction intersecting with a direction in which the connector terminals 101 is inserted into and pulled out of the connector terminal 30.

Figure 13A:
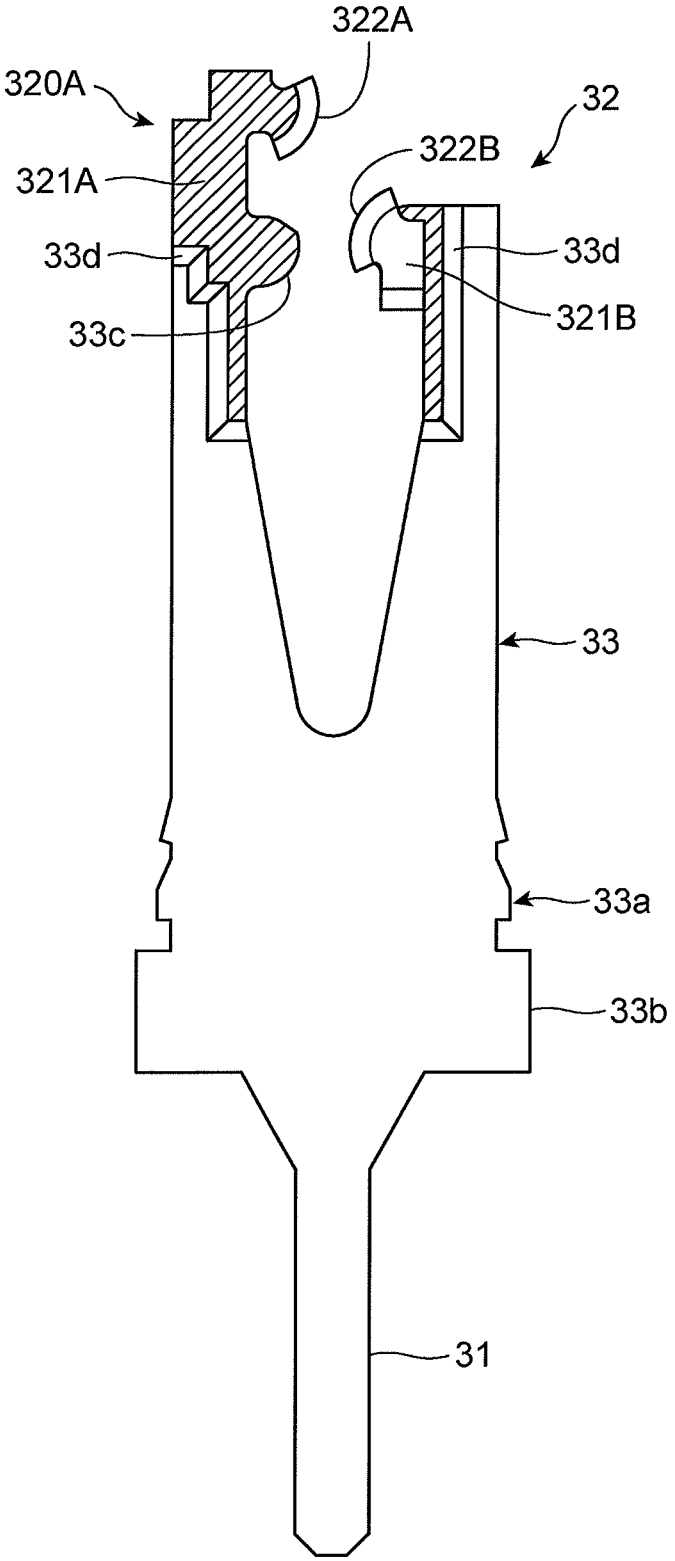
FIG. 13A is a front view of the connector terminal, showing that one of the first parts is folded.
Figure 13B:
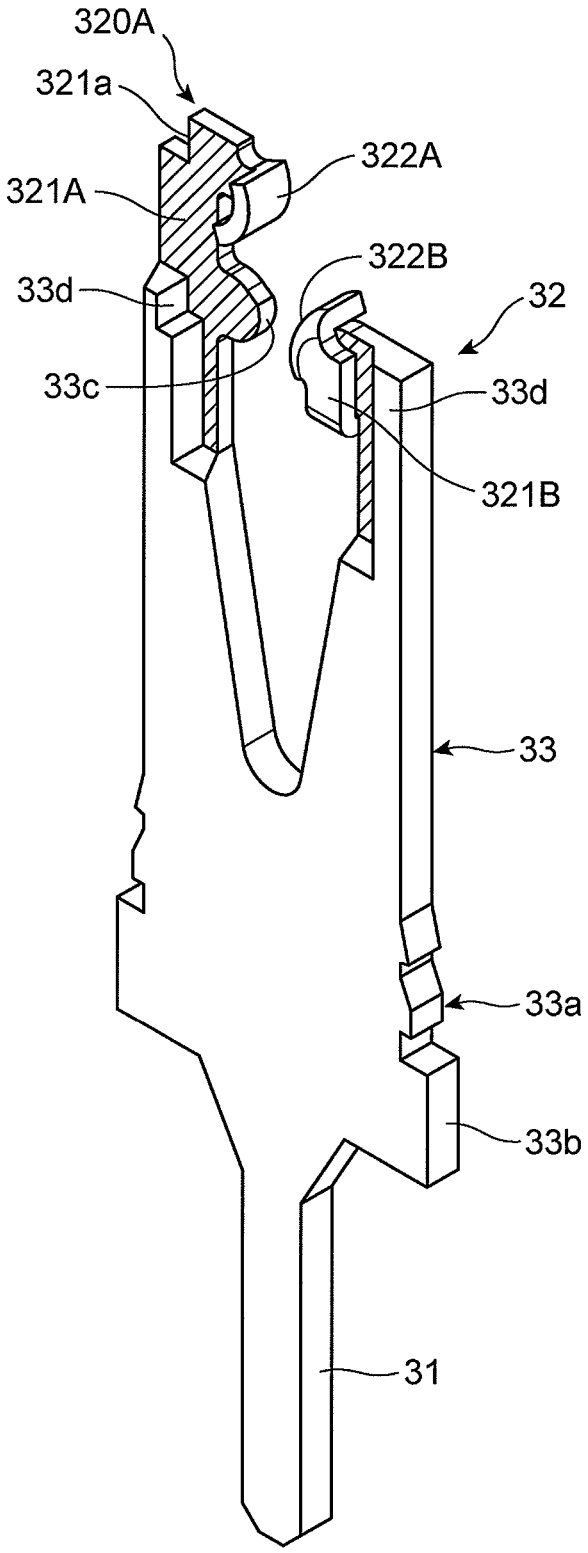
FIG. 13B is a perspective view of FIG. 13A.

Then, as illustrated in FIGS. 13A and 13B, the second part 321B is folded into two layers by cutting and bending process.

Figure 14A:
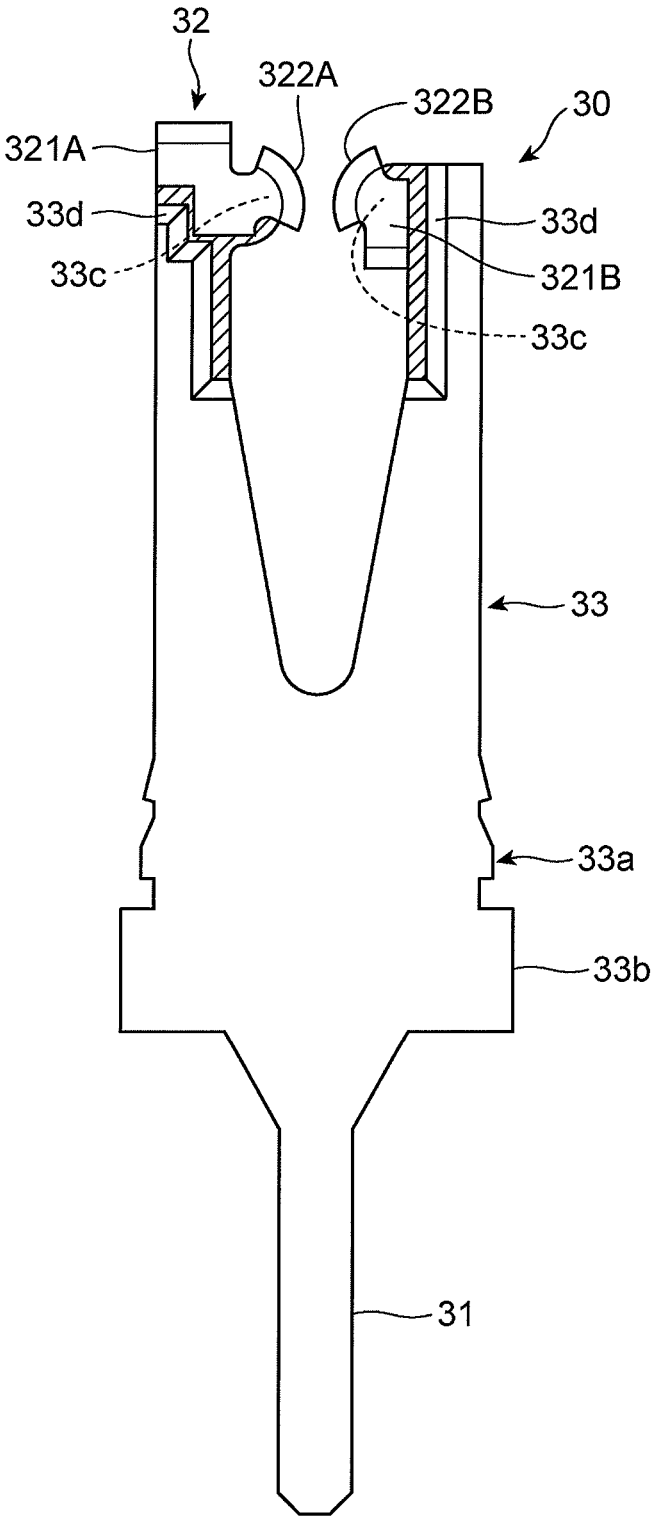
FIG. 14A is a front view of the connector terminal, showing that the other of the first parts is folded.
Figure 14B:
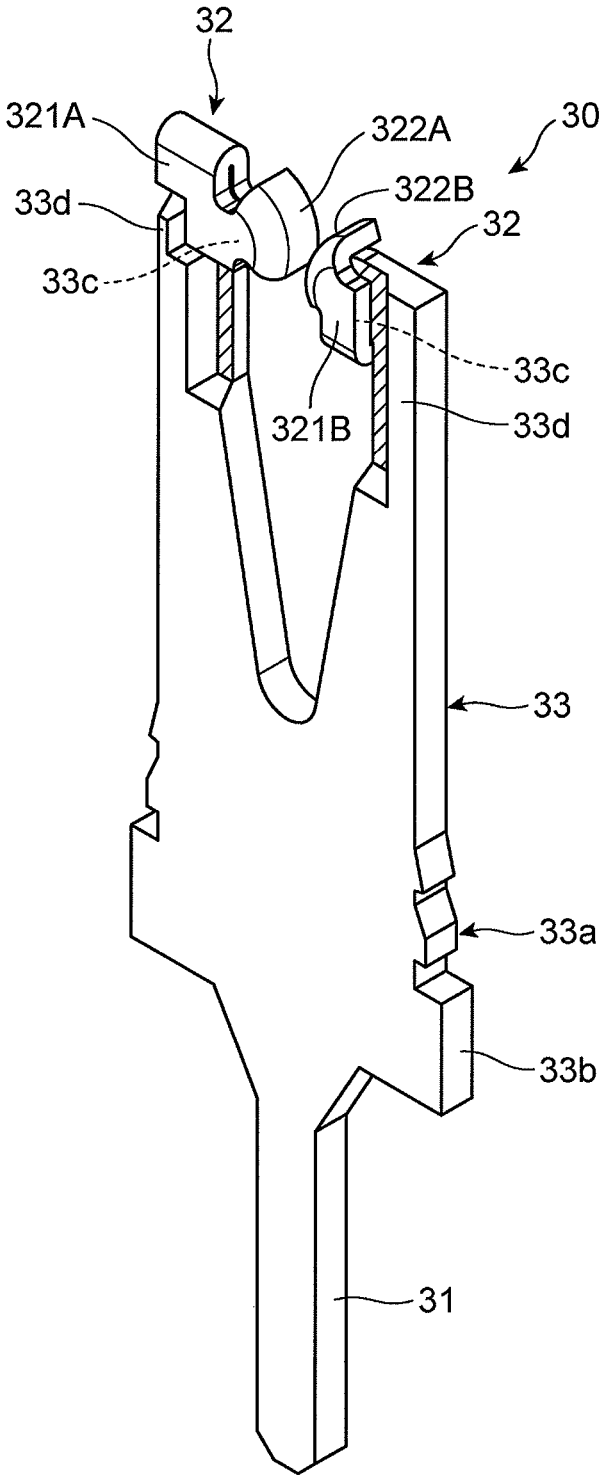
FIG. 14B is a perspective view of FIG. 14A.

Then, as illustrated in FIGS. 14A and 14B, the first part 321A is folded by heming process.

After the above-mentioned steps were carried out, the contact parts 322A and 322B are bent such that they face each other ahead of the compressing portions 33*c*.

By processing the terminal contacts 32 of the connector terminal 30 in the above-mentioned way, it is possible to locate the contact parts 322A and 322B ahead of the compressing portions 33*c*, and direct the contact surfaces of the contact parts 322A and 322B towards the connector terminals 101.

Furthermore, since the first portion 320A and the second portion 320B are designed to be thinner than the terminal body 33, the folded first part 321A and the folded second part 321B would not be thick, ensuring that designability is enhanced, and the connector terminal 30 can be smoothly inserted into the terminal openings 24*a* of the housing 20.

The stroking and bending process illustrated in FIGS. 12A and 12B may be carried out prior to both the cutting and bending process illustrated in FIGS. 13A and 13B and the heming process illustrated in FIGS. 14A and 14B. The step of bending the first part 321A, illustrated in FIGS. 14A and 14B, may be carried out prior to the step of bending the second part 321B, illustrated in FIGS. 13A and 13B.

The electric connector 10 in accordance with the preferred embodiment of the present invention is used as follows.

As illustrated in FIG. 1, when the connector terminals 101 of the fuse 100 are inserted into the connector terminal 30, not rough surfaces just bladed without being treated, but the smooth and plated surfaces (contact surfaces) of the contact parts 322A and 322B make contact with the connector terminals 101 of the fuse 100. Accordingly, it is possible to avoid the connector terminals 101 from being damaged and peeled. Furthermore, since the contact parts 322A and 322B have plated contact surfaces, it is possible to reduce friction between the contact parts 322A and 322B and the connector terminals 101, ensuring that the connector terminals 101 of the fuse 100 can be smoothly inserted into and pulled out of the connector terminal 30. Furthermore, since the contact parts 322A and 322B are arcuate in a direction in which the connector terminals 101 are inserted into the connector terminal 30, it is possible to surely sandwich the connector terminals 101 between the contact parts 322A and 322B with less friction between the contact parts 322A and 322B and the connector terminals 101.

Since each of the contact parts 322A and 322B is stroked and bent to have an arcuate surface along an arcuate surface of the compressing portion 33*c*, it is possible to increase a strength of the contact parts 322A and 322B, and to avoid the contact parts 322A and 322B from being deformed, by causing the contact parts 322A and 322B to make contact with and thus be integral with the compressing portion 33*c*. Furthermore, since the contact parts 322A and 322B are able to transfer a compression force acting on the compression portion 33*c* to a rear surface of the contact parts 322A and 322B, it is possible to surely sandwich a male connector terminal between the contact parts 322A and 322B.

Since the convex step 33*d* formed when the first portion 320A is thinned makes engagement with the cut-out 321*a* when the first part 321A is folded, the first portion 320A can be prevented from being outwardly deformed. Similarly, the step 33*d* formed when the first portion 320B is thinned prevents the first part 321B from being outwardly deformed. Since the first portions 320A and 320B are folded inwardly of the compressing portions 33*c* in a thickness-wise direction in the above-mentioned way, it is possible to prevent the first parts 321A and 321B from being deformed outwardly in a thickness-wise direction, by virtue of a reaction force generated when the connector terminals 101 are sandwiched between the contact parts 322A and 322B.

As mentioned above, in the connector terminal 30 in accordance with the preferred embodiment, even if the contact parts 322A and 322B extend beyond the central axis L, the contact parts 322A and 322B are designed to extend towards each other from heads of the first part 321A and the second part 321B extending in the opposite directions, and hence, the contact parts 322A and 322B do not face each other. Accordingly, when the contact parts 322A and 322B are formed of a metal plate, it is possible to form contact parts 322A and 322B without interfering with each other. Thus, a distance between the contact surfaces of the contact parts 322A and 322B facing each other can be shortened, and the contact surfaces can be widened, ensuring that the connector terminals 101 can be sandwiched with the plated contact surfaces. Thus, the electric connector 10 can be down-sized, and present high reliability in connection.

Figure 15:
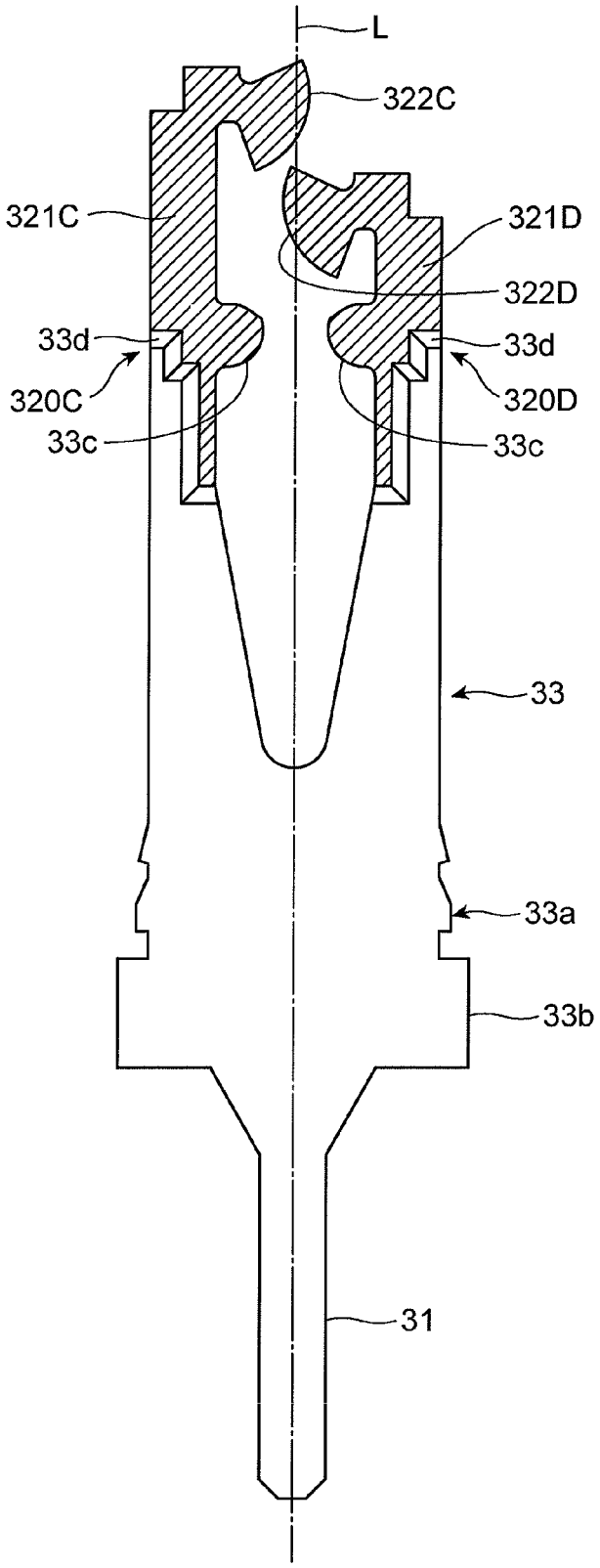
FIG. 15 is a front view of the connector terminal in accordance with another embodiment of the present invention, showing that the first portion is collapsed.
Figure 16:
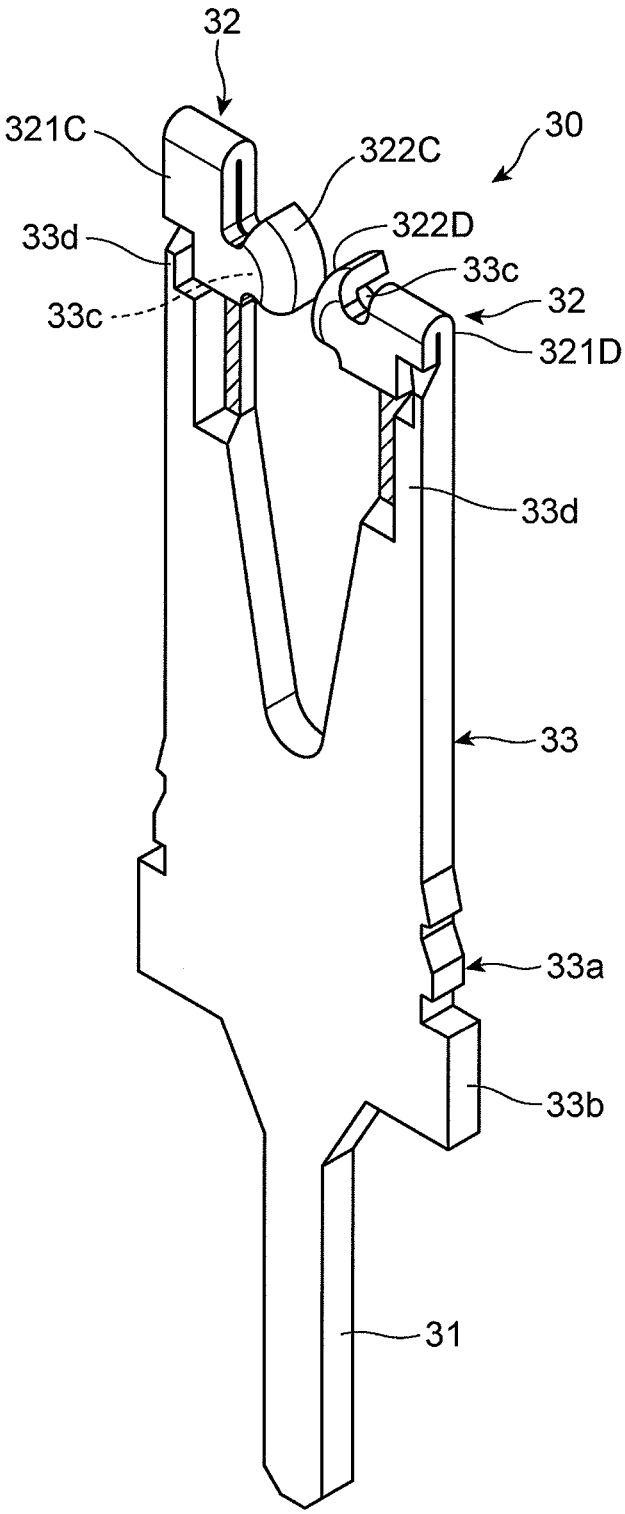
FIG. 16 is a perspective view of the connector terminal of another embodiment shown in FIG. 15 after bending.
Figure 17:
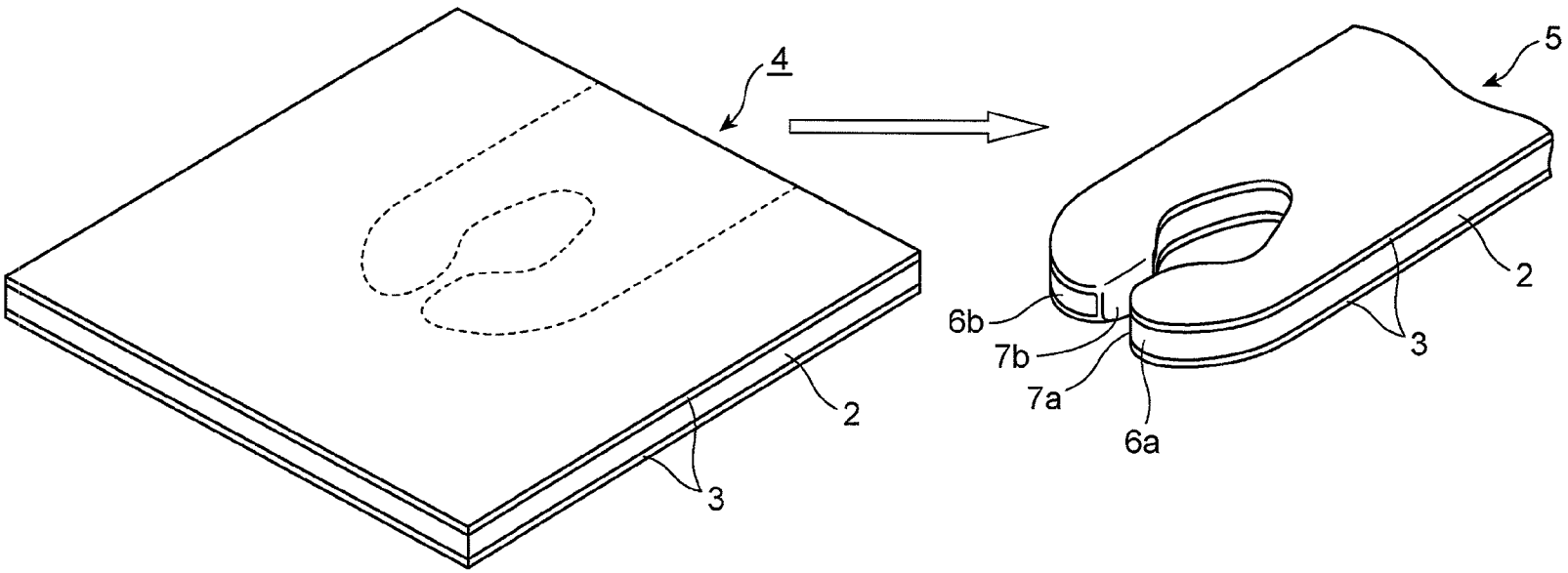
FIG. 17 is a perspective view of the conventional fork terminal.
Figure 18:
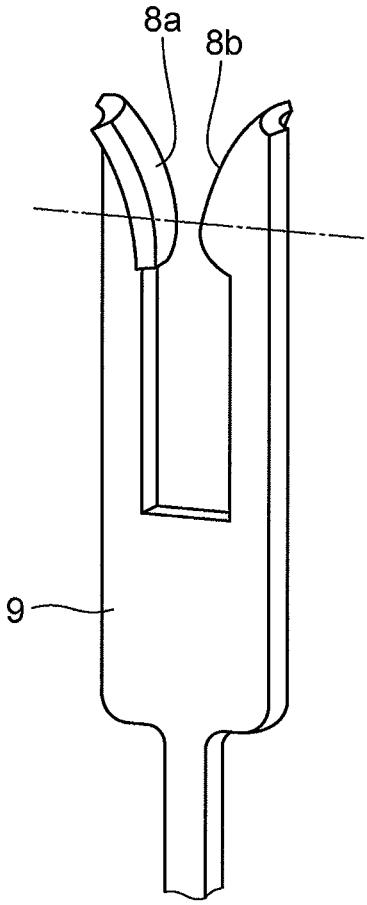
FIG. 18 PRIOR ART
FIG. 18 is a perspective view of the conventional connector.

Although the first part 321A and the second part 321B of the first portion 320A and the second portion 320B are designed in the preferred embodiment to extend and turn back in the opposite directions, that is, the directions in which the connector terminals 101 is inserted into and pulled out of the connector terminal 30, the first portion and the second portion may extend in the same direction. Such embodiment is shown in FIGS. 15 and 16. In this embodiment the first part 321C and the second part 321D may be designed to extend in the same directions, if the contact parts 322C and 322D do not face each other such that the contact parts 322C and 322D do not interfere with each other, for instance, by changing lengths of the first part 321C and the second part 321D.

INDUSTRIAL APPLICABILITY

The present invention is suitable to a connector terminal including a pair of terminal contacts into which a male connector terminal is inserted for making electrical contact with the terminal contacts. Thus, the present invention can be broadly employed in fields such as electric, electronic and automobile industries, as a connector to be used for electric and electronic parts and to be fit into a printed circuit board, or a connector to be mounted on an automobile.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

The entire disclosure of Japanese Patent Application No. 2012-149626 filed on Jul. 3, 2012 including specification, claims, drawings and summary is incorporated herein by reference in its entirety.

What is claimed is:

1. A connector terminal comprising:

a pair of terminal contacts sandwiching a male terminal therebetween to make electric contact with said male terminal; and a terminal body supporting said pair of terminal contacts;

wherein said terminal contacts are formed by bending a metal plate punched into a designed shape;

wherein said terminal contacts each include a contact surface formed by bending a respective contact part not facing a contact part of the other of said terminal contacts and extending towards a central axis of said terminal body so that contact surfaces of said pair of terminal contacts face each other at a determined position after bending;

wherein a first one of said pair of terminal contacts is formed by bending a first portion including a first part extending in a first direction in which said male terminal is pulled out of said connector terminal, said first portion further including a first contact part extending from said first part;

wherein a second one of said pair of terminal contacts is formed by bending a second portion including a second part turning back in a second direction in which said male terminal is inserted into said connector terminal, said second portion further including a second contact part extending from said second part;

wherein a first one of said first contact part and said second contact part is bent in a direction intersecting said first direction so that a contact surface of said first one of said first contact part and said second contact part faces said central axis of said terminal body, and said first part is folded; and wherein a second one of said first contact part and said second contact part is bent in a direction intersecting with said second direction so that a contact surface of said second one of said first contact part and said second contact part faces said central axis of said terminal body, and said second part is folded.

2. The connector terminal as set forth in claim 1, wherein said first contact part and said second contact part extend beyond said central axis of said terminal body before bending.

3. The connector terminal as set forth in claim 1, wherein said terminal body includes a pair of compressing portions extending towards said central axis, and said first contact part and said second contact part are bent in front of said compressing portions with respect to said central axis of said terminal body.

4. The connector terminal as set forth in claim 3, wherein each of said compressing portions has an arcuate distal end, and wherein each of said first contact part and said second contact part has an arcuate surface extending along said arcuate distal end of each of said compressing portions.

5. The connector terminal as set forth in claim 1, wherein said first portion and said second portion are thinner than said terminal body.

6. The connector terminal as set forth in claim 5, wherein said terminal body has a step at each boundary with said first portion and said second portion, and wherein each of said first part and said second part is bent inwardly of said step.

7. A connector terminal comprising:

a pair of terminal contacts sandwiching a male terminal therebetween to make electric contact with said male connector; and a terminal body supporting said pair of terminal contacts;

wherein said terminal contacts are formed by bending a metal plate punched into a designed shape;

wherein said terminal contacts each include a contact surface formed by bending a respective contact part not facing a contact part of the other of said terminal contacts and extending towards a central axis of said terminal body so that contact surfaces of said pair of terminal contacts face each other at a determined position after bending;

wherein a first one of said pair of terminal contacts is formed by bending a first portion including a first part extending in a first direction in which said male terminal is pulled out of said connector terminal, said first portion further including a first contact part extending from said first part;

wherein a second one of said pair of terminal contacts is formed by bending a second portion including a second part extending in said first direction, said second portion further including a second contact part extending from said second part;

wherein a position of said first contact part is different from a position of said second contact part along said first direction;

wherein a first one of said first contact part and said second contact part is bent in a direction intersecting with said first direction so that a contact surface of said first one of said first contact part and said second contact part faces said central axis of said terminal body, and said first part is folded, wherein a second one of said first contact part and said second contact part is bent in a direction intersecting with said first direction so that a contact surface of said second one of said first contact part and said second contact part faces said central axis of said terminal body, and said second part is folded.

8. The connector terminal as set forth in claim 7, wherein said first contact part and said second contact part extend beyond said central axis of said terminal body before bending.

9. The connector terminal as set forth in claim 7, wherein said terminal body includes a pair of compressing portions extending towards said central axis, and said first contact part and said second contact part are bent in front of said compressing portions with respect to said central axis of said terminal body.

10. The connector terminal as set forth in claim 9, wherein each of said compressing portions has an arcuate distal end, and wherein each of said first contact part and said second contact part has an arcuate surface extending along said arcuate distal end of each of said compressing portions.

11. The connector terminal as set forth in claim 7, wherein said first portion and said second portion are thinner than said terminal body.

12. The connector terminal as set forth in claim 11, wherein said terminal body has a step at each boundary with said first portion and said second portion, and wherein each of said first part and said second part is bent inwardly of said step.

13. A method of fabricating a terminal connector including a pair of terminal contacts sandwiching a male terminal therebetween to make electric contact with said male terminal, and a terminal body supporting said pair of terminal contacts, said method comprising:

forming a pair of contact parts which do not face each other; and bending said contact parts to thereby form said pair of terminal contacts;

wherein a first one of said pair of terminal contacts is formed by bending a first portion including a first part extending in a first direction in which said male terminal is pulled out of said connector terminal, said first portion further including a first contact part extending from said first part;

wherein a second one of said pair of terminal contacts is formed by bending a second portion including a second part extending in a second direction in which said male terminal is inserted into said connector terminal, said second portion further including a second contact part extending from said second part;

wherein a position of said first contact part is different from a position of said second contact part along said first direction;

wherein a first one of said first contact part and said second contact part is bent in a direction intersecting with said first direction so that a contact surface of said first one of said first contact part and said second contact part faces a central axis of said terminal body, and said first part is folded; and wherein a second one of said first contact part and said second contact part is bent in a direction intersecting with said second direction so that a contact surface of said second one of said first contact part and said second contact part face said central axis of said terminal body, and said second part is folded.

14. The method as set forth in claim 13, wherein each of said contact parts is bent in front of a compressing portion of said terminal body with respect to said central axis of said terminal body, and extends towards said central axis.

15. The method as set forth in claim 13, wherein said first part is bent inwardly with respect to a first step formed in said terminal body at a first boundary between a predetermined area and said first portion, and said second part is bent inwardly with respect to a second step formed in said terminal body at a second boundary between said predetermined area and said second portion.

16. A method of fabricating a terminal connector including a pair of terminal contacts sandwiching a male terminal therebetween to make electric contact with said male terminal, and a terminal body supporting said pair of terminal contacts, said method comprising:

forming a pair of contact parts which do not face each other; and bending said contact parts to thereby form said pair of terminal contacts;

wherein a first one of said pair of terminal contacts is formed by bending a first portion including a first part extending in a first direction in which said male terminal is pulled out of said connector terminal, said first portion further including a first contact part extending from said first part;

wherein a second one of said pair of terminal contacts is formed by bending a second portion including a second part extending in said first direction, said second portion further including a second contact part extending from said second part;

wherein a position of said first contact part is different from a position of said second contact part along said first direction;

wherein a first one of said first contact part and said second contact part is bent in a direction intersecting with said first direction so that a contact surface of said first one of said first contact part and said second contact part faces a central axis of said terminal body, and said first part is folded; and wherein a second one of said first contact part and said second contact part is bent in a direction intersecting with said second direction so that a contact surface of said second one of said first contact part and said second contact part faces said central axis of said terminal body, and said second part is folded.

17. The method as set forth in claim 16, wherein each of said contact parts is bent in front of a compressing portion of said terminal body with respect to said central axis of said terminal body, and extends towards said central axis.

18. The method as set forth in claim 16, wherein said first part is bent inwardly with respect to a first step formed in said terminal body at a first boundary between a predetermined area and said first portion, and said second part is bent inwardly with respect to a second step formed in said terminal body at a second boundary between said predetermined area and said second portion.

* * * * *